US005095587A

United States Patent [19]

Klüttermann et al.

[11] Patent Number: 5,095,587

[45] Date of Patent: Mar. 17, 1992

[54] METHOD AND APPARATUS FOR AUTOMATICALLY STARTING FORMATION OF SLIVER FROM A CARDED WEB

[75] Inventors: Jürgen Klüttermann, Mönchengladbach; Ferdinand Leifeld, Kempen; Paul Teichmann, Mönchengladbach, all of Fed. Rep. of Germany

[73] Assignee: Trützschler GmbH & Co. KG, Mönchengladbach, Fed. Rep. of Germany

[21] Appl. No.: 561,137

[22] Filed: Aug. 1, 1990

[30] Foreign Application Priority Data

Aug. 7, 1989 [DE] Fed. Rep. of Germany ..... 3926071
May 26, 1990 [DE] Fed. Rep. of Germany ..... 4017064

[51] Int. Cl.[5] ..... D01G 27/00; D01H 5/72

[52] U.S. Cl. ..... 19/150; 19/159 R

[58] Field of Search ..... 19/106 R, 150, 152, 19/153, 157, 159 R, 159 A

[56] References Cited

U.S. PATENT DOCUMENTS

| | | | |
|---|---|---|---|
| 3,083,416 | 4/1963 | Hashimoto | 19/159 R |
| 3,825,975 | 7/1974 | Staeheli | 19/150 |
| 3,840,942 | 10/1974 | Thomason, Jr. | 19/150 |
| 4,213,553 | 7/1980 | Leifeld | 19/106 R |
| 4,232,426 | 11/1980 | Beneke et al. | 19/106 R |
| 4,275,482 | 6/1981 | Leifeld | 19/150 |
| 4,372,010 | 2/1983 | Gauvain | 19/159 R |
| 4,404,711 | 9/1983 | Klüttermann | 2/106 R |
| 4,501,048 | 2/1985 | Varga | 19/106 R |
| 4,965,912 | 10/1990 | Kluttermann et al. | 19/159 R |
| 5,018,246 | 5/1991 | Leifeld | 19/150 |

FOREIGN PATENT DOCUMENTS

| | | | |
|---|---|---|---|
| 0141691 | 5/1985 | European Pat. Off. . | |
| 0314310 | 5/1989 | European Pat. Off. . | |
| 2624015 | 12/1976 | Fed. Rep. of Germany . | |
| 7708228 | 2/1980 | Fed. Rep. of Germany . | |
| 2931568 | 2/1981 | Fed. Rep. of Germany . | |
| 3036579 | 6/1982 | Fed. Rep. of Germany | 19/106 R |
| 4017064 | 2/1991 | Fed. Rep. of Germany . | |
| 60-30048 | 7/1986 | Japan | 19/106 R |
| 2062920 | 3/1987 | Japan | 19/106 R |
| 641120 | 2/1984 | Switzerland . | |
| 1155598 | 6/1969 | United Kingdom | 19/150 |
| 1323915 | 7/1973 | United Kingdom . | |

*Primary Examiner*—Werner H. Schroeder
*Assistant Examiner*—Michael A. Neas
*Attorney, Agent, or Firm*—Spencer & Frank

[57] ABSTRACT

An automatic startup device includes a roll assembly for discharging the fiber web; a web transporting arrangement situated under the roll assembly for gathering and advancing the web; and a trumpet situated under the web transporting arrangement. The trumpet has separable parts between which the web in introduced. In a first position the two trumpet parts are at a relatively large distance from one another, whereby the web is discharged by the trumpet in a substantially unaltered state and in a second position the two trumpet parts are at a relatively small distance from one another, whereby the web is compressed and discharged by the trumpet as a sliver. There are further provided a web delivery arrangement under the trumpet for receiving and removing the web; and a calender roll pair arranged under the trumpet for receiving and advancing the sliver discharged by the trumpet.

28 Claims, 9 Drawing Sheets

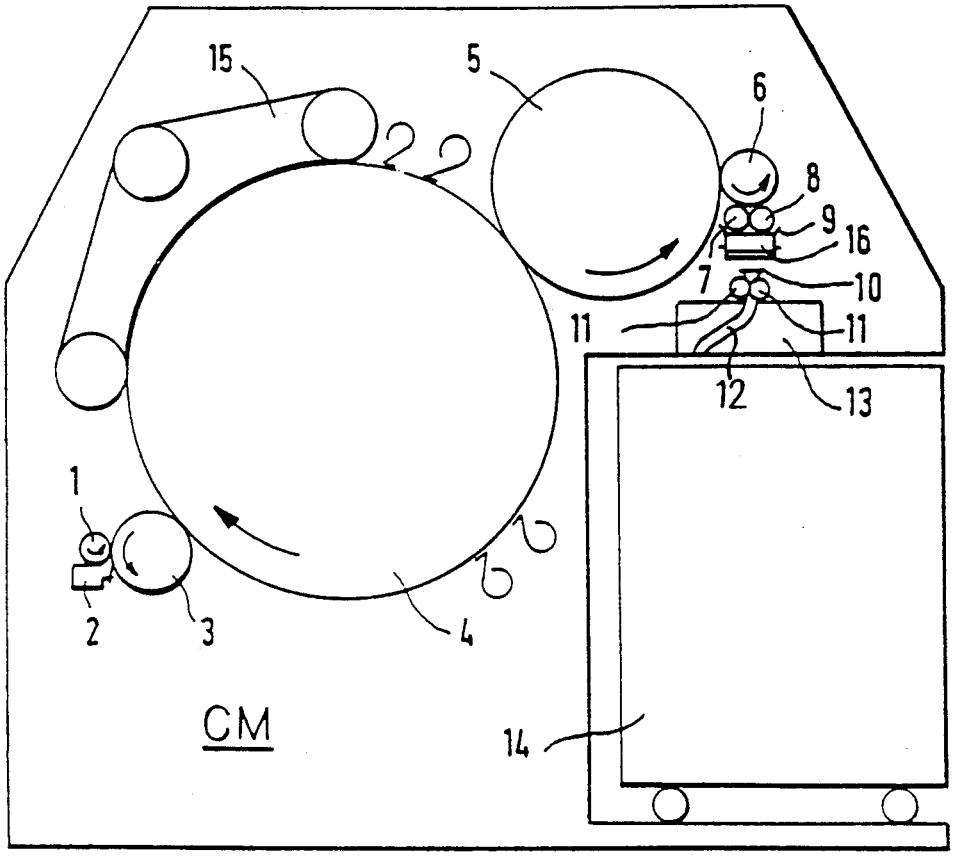
FIG.1
FIG. 1a
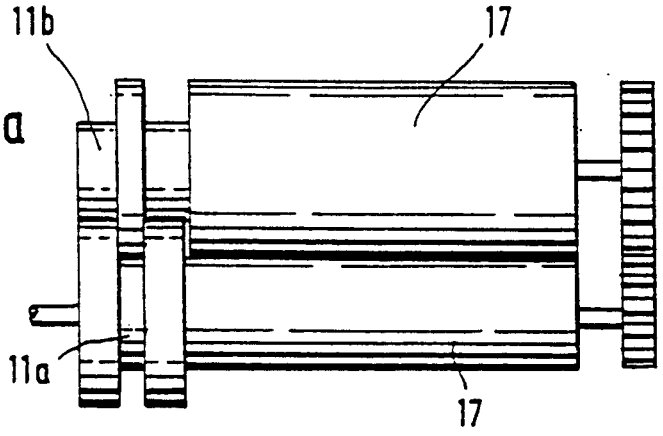

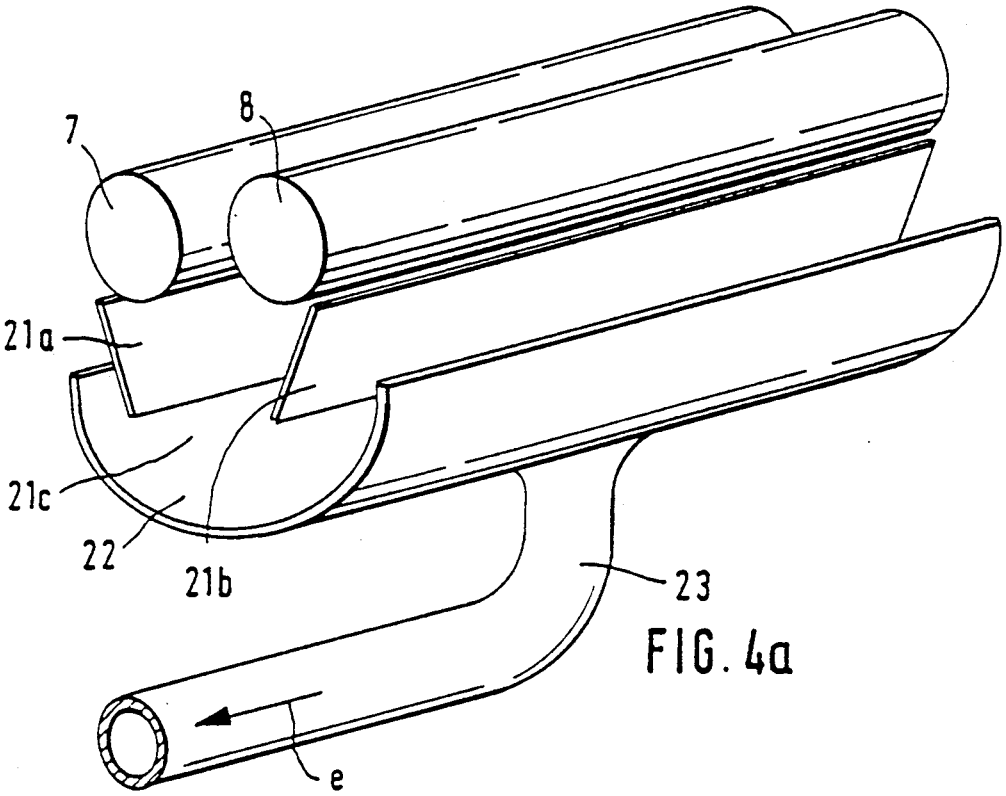
FIG. 4a
FIG. 4b
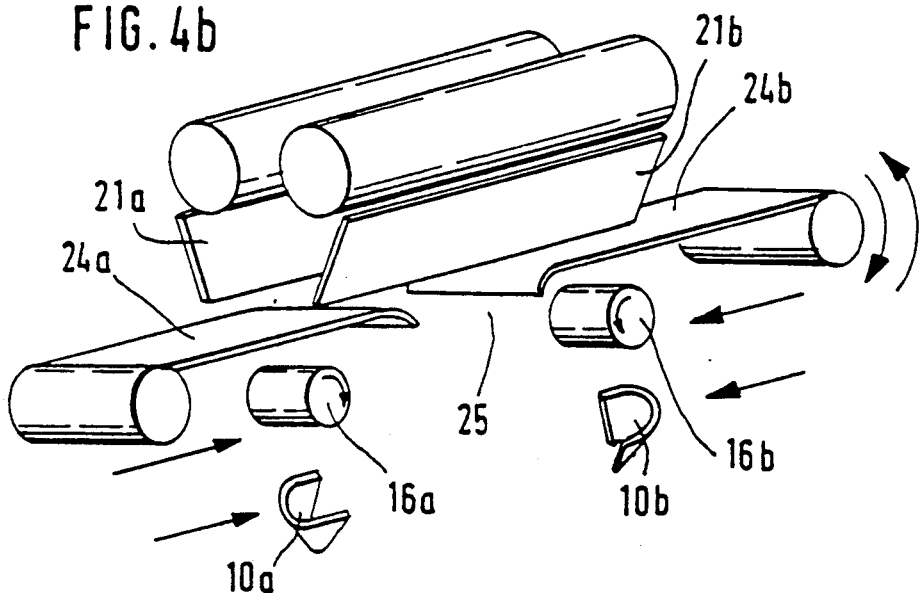

METHOD AND APPARATUS FOR AUTOMATICALLY STARTING FORMATION OF SLIVER FROM A CARDED WEB

CROSS REFERENCE TO RELATED APPLICATION

This application claims the priority of Federal Republic of Germany Application Nos. P 39 26 071.2 filed Aug. 7, 1989 and P 40 17 064.0 filed May 26, 1990, which are incorporated herein by reference.

BACKGROUND OF THE INVENTION

This invention relates to a method and apparatus for automatically grasping the leading end of a fiber web to start sliver formation therefrom. The method and apparatus is used, for example, in a carding machine in which the fiber web obtained from a roller assembly of the card is at least in part gathered and further advanced by a web transporting device, and in the starting phase the non-utilizable fiber web length is admitted to a web delivery device and is subsequently removed therefrom. In the thread-in phase the useful fiber web is surrounded by a trumpet and shaped into a sliver and further, the sliver discharged by the trumpet is advanced to a calender roll pair.

In practice, prior to the thread-in, the non-utilizable fiber web obtained, for example, from the crushing rolls is in a first step (starting phase) gathered by hand and thereafter torn off and removed. In a second phase (thread-in and production phases) the useful fiber web which is also discharged by the roll assembly of the card is gathered manually and thereafter, it is manually tapered and threaded through a trumpet into the gap formed by a calender roll pair which grasps the sliver and advances it to a sliver coiler which, in turn, deposits the sliver into a coiler can.

Published European Patent Application 314,310 discloses a method according to which the fiber web is gathered by two take-off belts and is compressed to a pre-sliver and further transported by two transfer or conveying rolls. During this phase of operation, a two-part segmented trumpet is in its open position so that the pre-sliver is not contacted by the trumpet. Also during this phase, the transfer rolls are driven with a first speed which is two to three times greater than the circumferential speed of the take-off belts, whereby a removal of fibers from the pre-sliver occurs. This results in a significant stretch of the fibers between the transporting rolls of the take-off belts and the transfer rolls, whereby the non-utilizable fiber parts of the pre-sliver are, in the starting phase, separated and removed.

The transfer rolls tear large tufts or clumps from the pre-sliver which fall into a suction pipe and are removed as waste. The tearing of fiber parts from the pre-sliver results in a generally tapered leading or threading end for the pre-sliver. The tapered pre-sliver terminus is introduced downwardly into the V-shaped structure of an air trumpet.

After completion of the starting phase (first step), the speed of the transfer rolls is reduced to a second, normal speed so that the circumferential speed thereof corresponds to that of the take-off belts. After the starting phase the thread-in procedure (second step) is effected upon introduction of the tapered pre-sliver into the air trumpet. From the air trumpet a tapered sliver emerges which, in turn, enters into the gap between a groove-and-feather roll pair and subsequently the sliver is deposited in the coiler can. As the carding machine has attained its normal production speed, in a third step the two parts of the segmented trumpet are brought together to thus place the trumpet in a closed position in order to surround the pre-sliver for preventing an expansion thereof over the surface of the transfer rolls. Stated differently, the segmented trumpet participates neither in the sliver formation nor in the tapering procedure of the fiber sliver.

It is a disadvantage of the above-outlined process that the terminus of the pre-sliver may rupture completely when large tufts or clumps are torn therefrom, causing the flow of fiber material to be interrupted, and thus an introduction of the pre-sliver into the fast-rotating transfer rolls cannot be effected in a satisfactory manner. Further, an undesired settling or clogging may occur. It is a further significant disadvantage of the above-outlined arrangement that the sliver formation is effected by pneumatic forces in the air trumpet. Such an arrangement is significantly complex and expensive and, particularly in case of errant air streams, leads to operational disturbances and consequently, a fully automatic thread-in is not possible.

SUMMARY OF THE INVENTION

It is an object of the invention to provide an improved method and apparatus of the above-outlined type from which the discussed disadvantages are eliminated and which, in particular, permits a reliable automatic startup in a simple and disturbance-free manner.

This object and others to become apparent as the specification progresses, are accomplished by the invention, according to which, briefly stated, the automatic startup device includes a roll assembly for discharging the fiber web; a web transporting arrangement situated under the roll assembly for gathering and advancing the web; and a trumpet situated under the web transporting arrangement. The trumpet has separable parts between which the web is introduced. In a first position the two trumpet parts are at a relatively large distance from one another, whereby the web is discharged by the trumpet in a substantially unaltered state and in a second position the two trumpet parts are at a relatively small distance from one another, whereby the web is compressed and discharged by the trumpet as a sliver. There are further provided a web delivery arrangement under the trumpet for receiving and removing the web; and a calender roll pair arranged under the trumpet for receiving and advancing the sliver discharged by the trumpet.

By virtue of the fact that in the starting phase the non-utilizable web is advanced with a uniform speed, its further transportation and removal without interruption is possible. In contrast to known processes, the complicated, rpm-controlled tapering of a pre-sliver is dispensed with; such a tapering is not even possible because of the through-going fiber flow. By virtue of a further inventive measure, according to which, after the thread-in phase (second step) the sliver is formed by gathering or mechanical narrowing of the useful fiber web, advantageously the tapering operation is simultaneously introduced: while a wide fiber web enters into the gathering trumpet, a compressed, narrow sliver is discharged thereby. It is a further advantage of the invention that the sliver is severed by a clamping device in the trumpet, whereby a tapered end of the fiber sliver is obtained without the need of a complex pneumatic device which the prior art has utilized for the sliver formation and for emulating the manual tapering of the sliver terminus. Further, the leading end of the sliver exiting from the clamping trumpet is introduced along a predetermined path into the calender rolls and grasped thereby. Thus, the process according to the invention permits an advantageous automatic startup in an operationally safe and disturbance-free manner.

The non-utilizable fiber web discharged by the delivery device is expediently removed by suction.

The apparatus for performing the process according to the invention has a roll assembly formed, for example, by a doffer, a stripping roll, crushing rolls or the like and further has a fiber web advancing device for gathering and advancing the fiber web downstream of the roll assembly. Downstream of the fiber web transporting device a further conveying device is arranged, underneath which there is situated a trumpet followed by calender roll pair. According to the invention, the web transporting device is situated vertically or obliquely below the roll assembly and the conveying device is situated underneath the web transporting device. The trumpet is designed as a gathering trumpet and is arranged underneath the web transporting device and above the conveying device and the calender roll pair. The gathering trumpet, the conveying device and/or the calender roll pair are displaceable relative to one another. By situating the web transporting device, the conveying device, the gathering trumpet and the calender roll pair underneath the roll assembly, for example, underneath the crushing rolls of the carding machine, the fiber material advantageously drops downwardly by gravity, whereby the transport and conveying processes are enhanced. At the same time, in contrast to known apparatus, a significant structural simplification is achieved.

BRIEF DESCRIPTION OF THE DRAWING

FIG. 1 is a schematic side elevational view of the carding machine incorporating the invention.

FIG. 1*a* is an enlarged schematic top plan view of details of the structure shown in FIG. 1.

FIGS. 4*a* and 4*b* are schematic perspective views of parts of still another preferred embodiment of the invention.

DESCRIPTION OF THE PREFERRED EMBODIMENTS

Figure 2A:
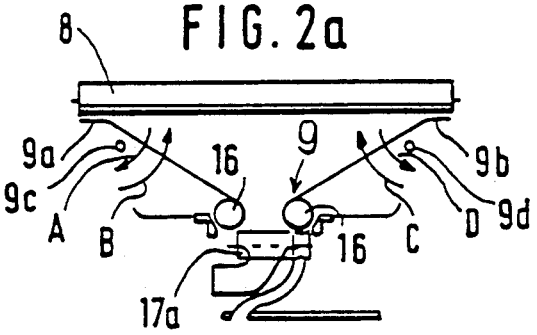
FIGS. 2*a*–2*f* are schematic front elevational views of a preferred embodiment of the invention shown in different operational positions.

Turning to FIG. 1, there is shown therein a carding machine CM which may be an EXACTACARD DK model manufactured by Trützschler GmbH & Co. KG, Mönchengladbach, Federal Republic of Germany. The carding machine has a feed roll 1, a feed table 2, a licker-in 3, a main carding cylinder 4, a doffer 5, a stripping roll 6, crushing rolls 7, 8, a web guiding element 9, a sliver trumpet 10, calender rolls 11, a sliver-guiding tube 12, a sliver coiler 13, a coiler can 14 as well as travelling flats 15. The curved arrows drawn into the various rolls indicate directions of rotation. The web guiding element 9 which serves as a web advancing device for gathering and transporting the fiber web discharged by the crushing rolls 7, 8 is situated substantially vertically below the crushing roll 7, 8. The web guiding element 9 is adjoined by a pair of cooperating rolls 16.

Turning now to FIGS. 1*a* and 2*a*–2*f*, underneath the web guiding element 9 which is made of two movable parts 9*a* and 9*b*, there is situated a pair of delivery rolls 17. The web guiding element 9*a*, 9*b* and the rolls 16 are arranged vertically below the crushing rolls 7, 8. Further, vertically below the web guiding element 9*a*, 9*b* and the rolls 16 there are arranged the delivery rolls 17 and the calender rolls 11 in a horizontally adjoining, axially aligned relationship. The output side of the delivery rolls 17 is adjoined by a suction pipe 18 connected to a non-illustrated suction source. Between the web guiding element 9 and the delivery rolls 17 and the calender rolls 11 a gathering trumpet 10 is arranged which, as a unit, is shiftable in a horizontal direction and which is formed of two parts that are movable relative to one another in a horizontal direction.

In the description which follows, the operation shown in FIGS. 2*a*–2*f* will be set forth. In the starting phase (run-up phase) of the carding machine only fragmented, noncoherent web portions are produced which are not adapted to form a continuous fiber sliver. The web parts are, as shown in FIG. 2*a*, gathered by the web guiding element 9 whose guide faces 9*a* and 9*b* form a downwardly open triangle. The rolls 16 which are situated at the end of the respective guide face 9*a*, 9*b* grasp the fragmented web portions and advance them to the delivery rolls 17. The fiber web portions discharged by the delivery rolls 17 enter the suction tube 18 and are thus removed.

Figure 2B:
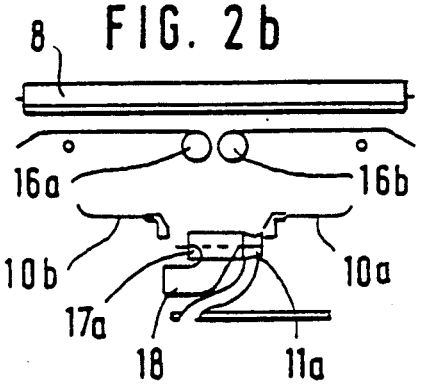
Figure 2C:
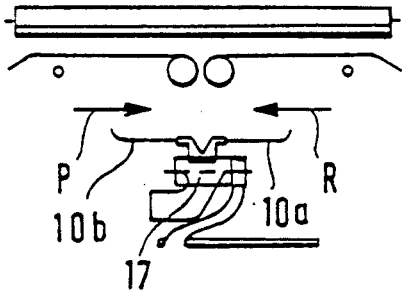

After a period of about 10–15 seconds the run-up phase of the carding machine is terminated, whereupon the guide faces 9*a*, 9*b* are pivoted about pivots 9*c*, 9*d* together with the respective rolls 16 upwardly in the direction of the arrow B towards the crushing rolls 7, 8 to assume their position as illustrated in FIG. 2*b*. Thereafter, the two halves 10*a*, 10*b* of the gathering trumpet 10 are moved towards one another as shown in FIG. 2*c* to thus surround the fiber web 19 as shown in FIG. 7*b*, as a result of which the constricted passage of the closed gathering trumpet 10 forms a fiber sliver 20 from the web 19.

Figure 2D:
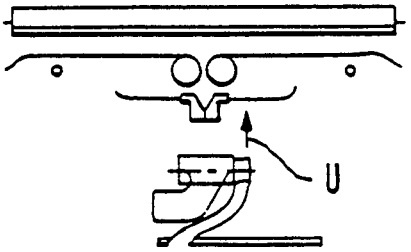
Figure 7A:
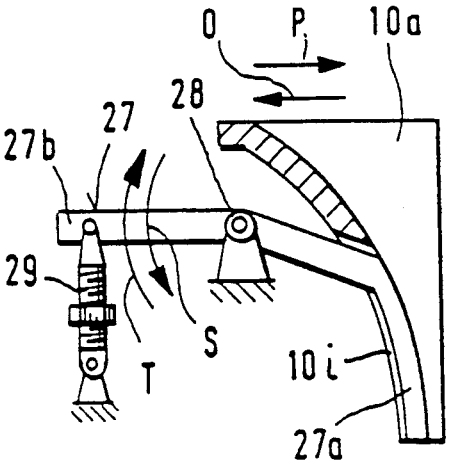
FIGS. 7*a* and 7*b* are schematic front elevational views of a two-piece gathering trumpet forming part of the invention.
Figure 7B:
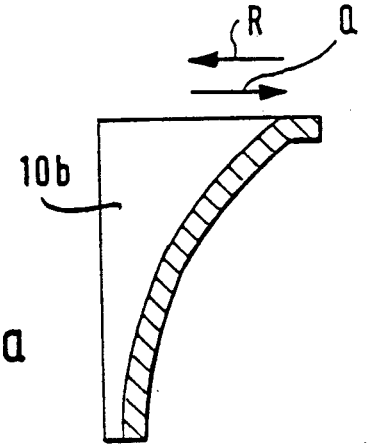
Figure 7B:
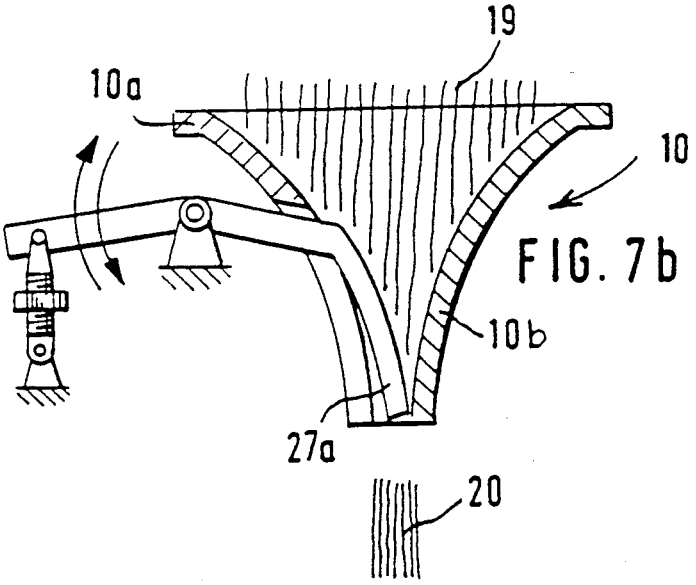

As shown in FIG. 2*d*, the gathering trumpet 10 is thereafter raised in the direction of the arrow U and the fiber sliver 20 is, as shown in FIG. 7*b*, severed as the sliver is clamped at the downstream end of the gathering trumpet 10 and continues to be pulled by the delivery rolls 17.

Figure 2E:
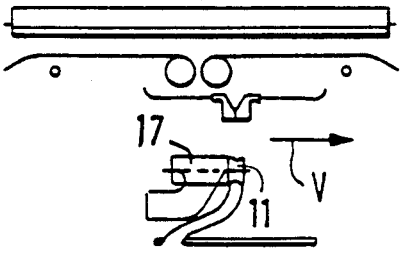
Figure 2F:
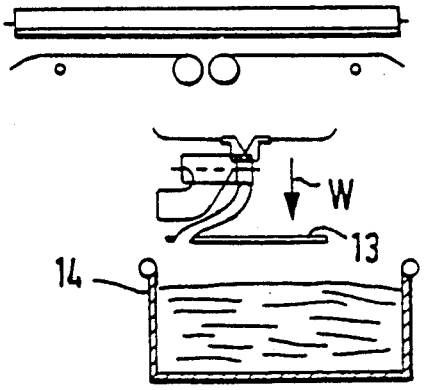

As shown in FIG. 2e, in a subsequent step the gathering trumpet 10 is moved horizontally in the direction of the arrow V into alignment with the calender rolls 11, the clamping device is released and thereafter the end of the gathering trumpet 10 is, as shown in FIG. 2f, moved vertically downwardly in the direction of the arrow W into the gap defined by the two calender rolls 11a, 11b. The calender rolls 11 grasp the terminus of the fiber sliver 10 projecting beyond the gathering trumpet 10 and continuously pull the sliver 20 from the gathering trumpet 10. As the final step, the sliver 20 is deposited into the coiler can 14 by the coiler mechanism 13 which includes the sliver guiding tube 12 through which the sliver passes.

Figure 3A:
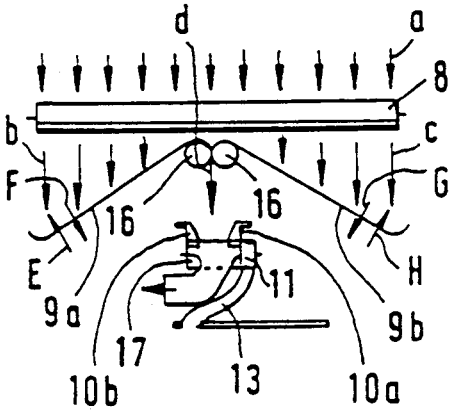
FIGS. 3*a*–3*f* are schematic front elevational views of another preferred embodiment of the invention illustrated in different operational positions.
Figure 3B:
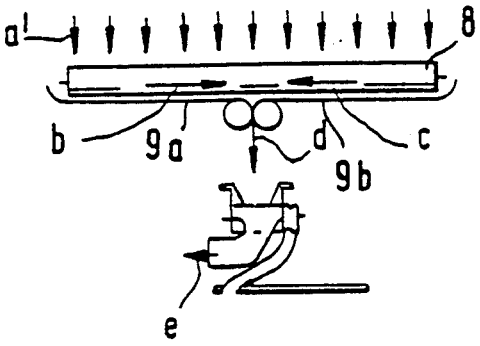
Figure 3C:
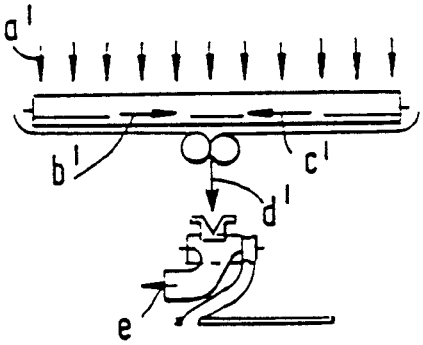
Figure 3D:
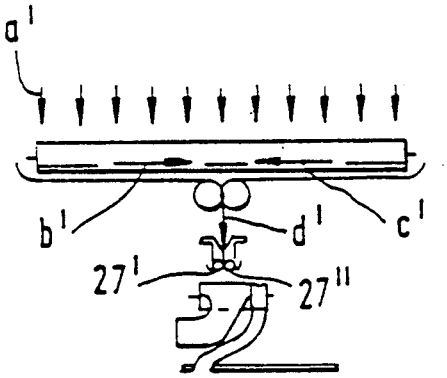

Another embodiment of the invention is illustrated in FIGS. 3a-3f, showing various operational positions. In these Figures the flow of fiber material is also shown, symbolized by arrows. The rolls 16 are non-displaceably supported in the immediate vicinity of the crushing rolls 7, 8. After completion of the startup phase (FIG. 3a) of the carding machine, the web guiding faces 9a, 9b pivot upwardly, substantially about the axis of rolls 16, to assume a position immediately adjacent and parallel to the crushing rolls 7, 8 as shown in FIG. 3b. The guide faces 9a and 9b have an upwardly oriented curved terminus. The mode of operation in the operational positions 3a-3f corresponds to that of the operation of the first-described embodiment, depicted in FIGS. 2a-2f, respectively. The flow of the non-utilizable fiber web 19 which is present in the starting phase is designated at a, b, c, d and e. The flow of the useful fiber web which is present in the thread-in phase subsequent to the startup phase, is designated at a', b', c' and d'. f designates the direction of advance of the fiber sliver 20.

Figure 5A:
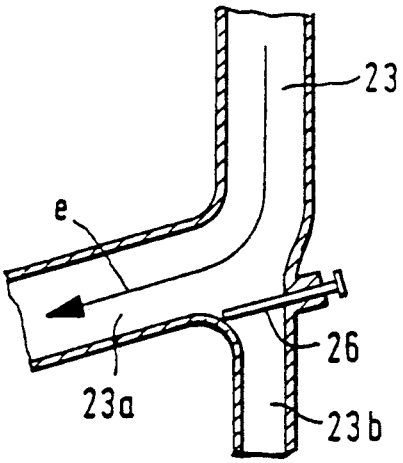
FIGS. 5*a* and 5*b* are schematic top plan views of parts of yet another preferred embodiment.
Figure 5B:
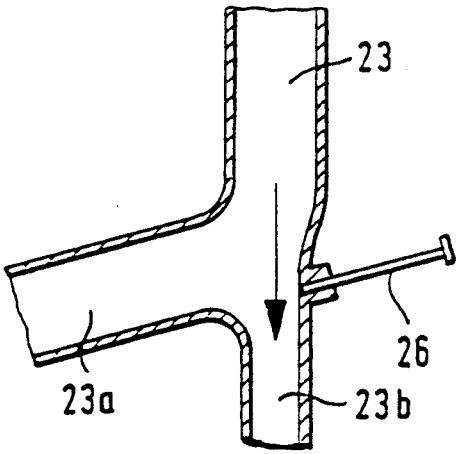

As illustrated in FIG. 4a, underneath the crushing rolls 7, 8 a web guide element having two downwardly converging guide faces (plates) 21a, 21b is provided. The guide faces 21a, 21b define an elongate bottom opening 21c and form a lateral screen. Underneath the bottom opening 21c a receiving trough 22 is provided which is adjoined by a suction tube 23 for the non-utilizable fiber web e. FIG. 4a shows the device in the startup phase. Subsequent to the startup phase the suction device 22, 23 is, in a manner not shown, moved away from under the crushing rolls 7, 8 and the web guide faces 21a, 21b and the bottom opening 21c are closed off from opposite sides by two cover belts 24a, 24b leaving only an opening 25 located centrally relative to the length of the plates 21a, 21b; as shown in FIG. 4b. The useful web exiting the opening 25 is transported downwardly by the cooperating rolls 16 which have been brought together into a cooperating relationship from their position shown in FIG. 4b. Thereafter the fiber web is gathered by the gathering trumpet 10a, 10b (whose halves were closed from the open position shown in FIG. 4b) to thus form a sliver from the web. As shown in FIGS. 5a and 5b, the suction pipe 23 has two outlets 23a and 23b separated from one another by a slidable gate 26 so that, as long as nonutilizable fiber web is supplied, the latter is guided into the outlet 23a. When useful fiber web enters the suction pipe 23 the gate 26 is withdrawn (as shown in FIG. 5b) so that the useful fiber web may exit through the outlet 23b.

Figure 6:
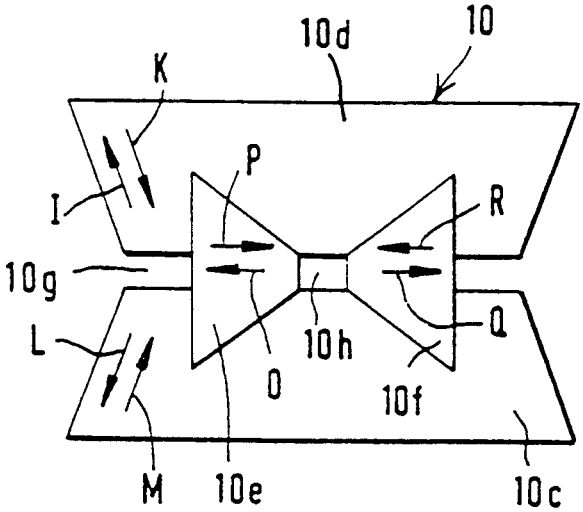
FIG. 6 is a schematic end view of a gathering trumpet forming part of the invention.

Turning now to FIG. 6, the gathering trumpet 10 schematically shown therein in a rear end view, as seen in the direction of sliver advance, has four obliquely arranged side walls 10c, 10d, 10e and 10f. The side walls 10c and 10d which together define an open downstream clearance 10g, are displaceable in the direction of arrows I, K and, respectively, L, M whereby the width of the clearance 10g may be adjusted. The side walls 10e and 10f are displaceable as indicated by the arrows O, P and, respectively, Q, R whereby the width and thus the area of the flow passage 10h of the gathering trumpet 10 may be changed. The motion of the lateral faces 10c and 10f corresponds to the motion of the halves 10a, 10b of the gathering trumpet 10 shown in FIGS. 2b, 2c and, respectively, 3b, 3c.

Turning to FIG. 7a, a clamping device, including a two-armed lever 27 is associated with the half 10a of the gathering trumpet 10. The two-armed lever 27 is swingable about a pivot 28. The lever arm 27a of the two-armed lever 27 projects through a slot 10i provided in the trumpet half 10a, while the arm 27b of the two-armed lever 27 is connected with a pneumatic cylinder 29. The lever 27 is rotatable as indicated by the arrows S and T. FIG. 7b depicts an operational position in which the two trumpet halves 10a and 10b have been brought together and further, the lever 27 has been actuated by the pneumatic cylinder 29 so that the free end portion of the arm 27a which constitutes the clamping element proper, presses the sliver 20 against the opposite inner wall of the trumpet half 10b (which corresponds to the operational step illustrated in FIGS. 2d, 3d). By virtue of the continuing rotation of the delivery rolls 17 a tension is generated so that the fiber sliver 20 breaks off at the clamping location.

Figure 3E:
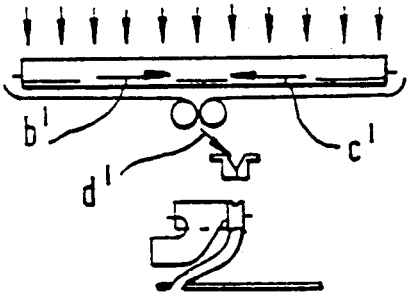
Figure 3F:
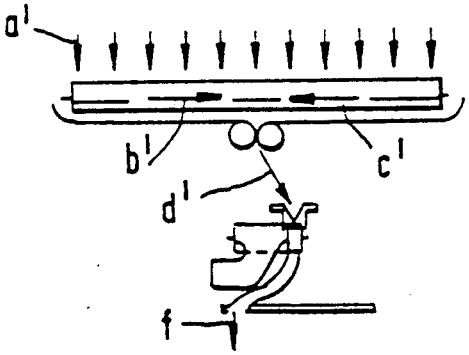
Figure 8:
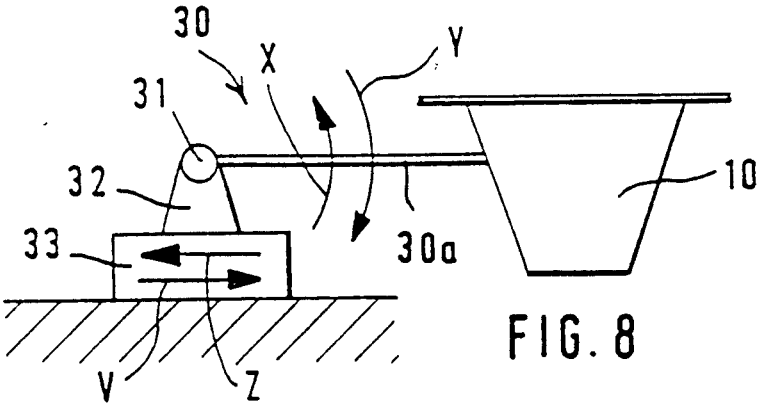
FIG. 8 is a schematic side elevational view of a holding device for a horizontally shiftable trumpet.

Turning to FIG. 8, there is illustrated therein a trumpet holder 30 including a lever 30a, one end of which carries the gathering trumpet 10 while its other end is held in a rotary bearing 31. By rotating the lever 30a in the direction of the arrows X or Y the gathering trumpet 10 is swung upwardly or downwardly in accordance with the steps depicted in FIGS. 3c, 3d. The bearing 31 is secured by a bracket 32 to a slide 33 which is linearly displaceable as indicated by the arrows V, Z whereby the gathering trumpet 10 may horizontally change its location as depicted in FIGS. 2e and 3e.

Figure 9A:
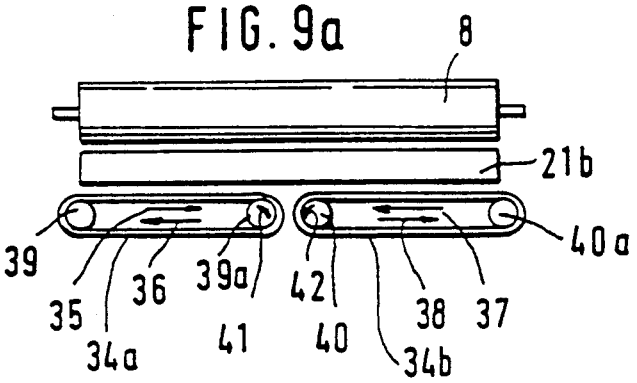
FIGS. 9*a*, 10*a* and 10*c* are schematic end elevational views
Figure 9B:
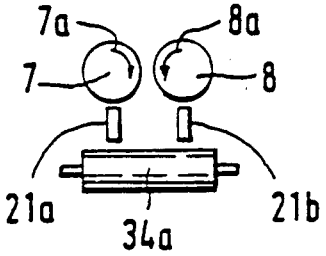
FIGS. 9*b*, 10*b* and 10*d* are schematic side elevational views of another preferred embodiment of the invention, depicted in different operational positions.

Turning to FIGS. 9a and 9b, underneath the crushing rolls 7 and 8 which are rotated in the direction of arrows 7a and 8a, there are provided two endless conveyor belts 34a, 34b which constitute a web transporting device and which are supported by end rollers 39, 39a and 40, 40a, respectively. The horizontal working surfaces of the two belts are movable in the direction of the arrows 35, 36, 37 and 38. The supporting end rolls 39 and 40 rotate in the direction of the arrows 41, 42, respectively. Between the crushing rolls 7, 8 and the conveyor belts 34a, 34b downwardly oriented air screening elements 21a, 21b are provided. The conveyor belts 34a and 34b are in the same position in the threading operation as in the normal operation.

Figure 10A:
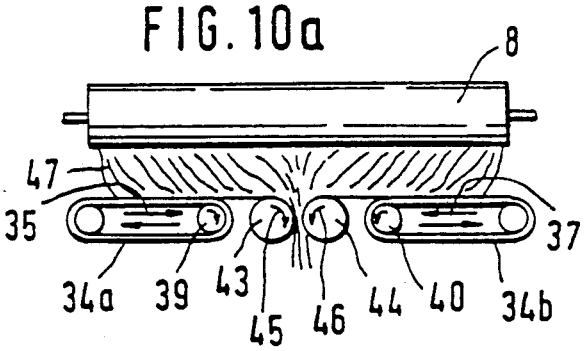
Figure 10B:
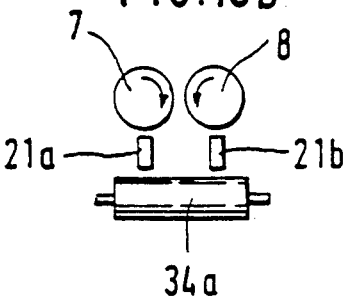
Figure 10C:
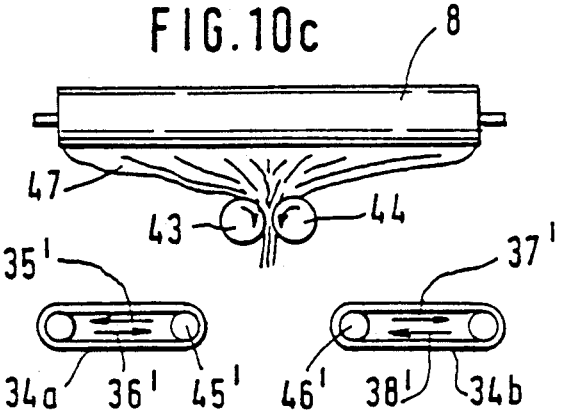
Figure 10D:
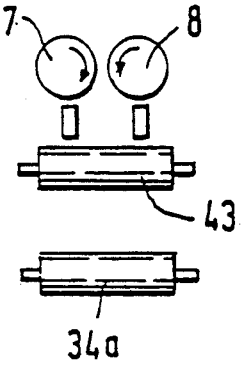

Turning now to FIGS. 10a and 10b, between the adjoining end rollers 39 and 40 of the conveyor belts 34a, 34b axially parallel rolls 43 and 44 are provided which rotate in the direction as indicated by the arrows 45 and 46. In the starting phase, according to FIGS. 10a and 10b, the conveyor belts 34a, 34b and the rolls 43, 44 are situated horizontally in a single plane. The fiber web emerges with a relatively low speed from between the crushing rolls 7, 8, impinges from above on the upper faces of the conveyor belts 34a, 34b and is thereafter conveyed in the direction of the arrows 35 and 37 and then exits through the gap defined between the rolls 33 and 34. In the consecutive operational phase as depicted in FIGS. 10c, 10d the rapidly moving fiber web 47 has an approximately triangular shape and is admitted from the crushing rolls 7, 8 directly into the gap defined by the rolls 43, 44 without contacting the conveying belts 34*a*, 34*b*. The conveyor belts 34*a*, 34*b* are movable vertically downwardly from their position shown in FIGS. 10*a*, 10*b* to the position shown in FIGS. 10*c*, 10*d*. Expediently, the surfaces of the conveyor belts 34*a*, 34*b* are movable in the direction of the arrows 35'–38', that is, the direction of motion is reversed compared to FIG. 10*a* and is directed outwardly so that the impurities dropping from the fiber web 47 such as trash, leaf or stem fragments and the like may be outwardly removed on the conveyor belts 34*a*, 34*b*.

Figure 11A:
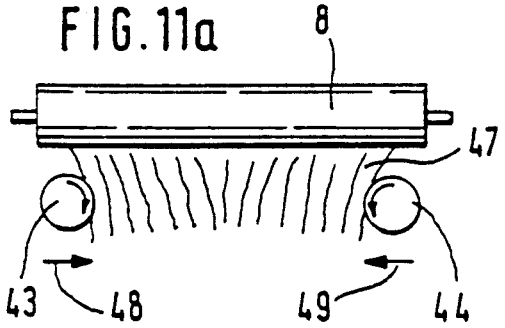
FIGS. 11*a*, 11*b*, 12*a*, 12*b*, 13*a*, 13*b* and 14*a*, 14*b* are schematic end elevational views of four further preferred embodiments shown in different operational positions.
Figure 11B:
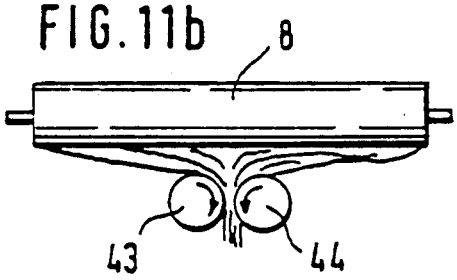

FIGS. 11*a*, 11*b* illustrate-an embodiment wherein the end rollers 43, 44 are moved away from one another for the threading operation (FIG. 11*a*). In the normal operational phase, as depicted in FIG. 11*b*, the rollers 43, 44 have been brought together by a non-illustrated supporting device as shown by arrows 48 and 49 in FIG. 11*a*.

Figure 12A:
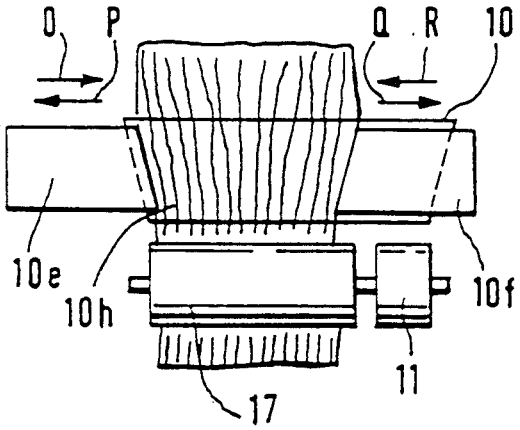
Figure 12B:
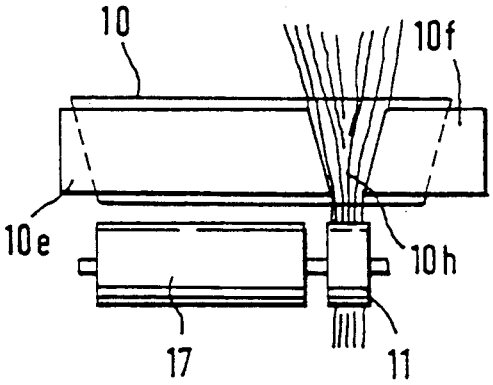

In FIG. 12 the gathering trumpet 10 is arranged stationarily above the delivery rolls 17 and the calender rolls 11. In the starting phase, corresponding to the illustration in FIG. 12*a*, the movable slide elements 10*e*, 10*f* are in a separated and leftward shifted position, so that the non-utilizable fiber material is grasped by the cooperating delivery rolls 17. In the operating phase, as shown in FIG. 12*b*, the slide elements 10*e*, 10*f* are in a close and rightward shifted position so that the useful material (that is, the fiber sliver) is admitted into the gap defined by the calender rolls 11. The stationary gathering trumpet 10 has a flow passage which may be regulated in a manner described in conjunction with FIG. 6.

The invention thus encompasses arrangements in which the sliver terminus emerging from the gathering trumpet 10 is introduced into the gap defined by the calender rolls 11 either by a shift of the entire gathering trumpet 10 or by a local shift of the wall faces within the stationarily arranged gathering trumpet.

Figure 13A:
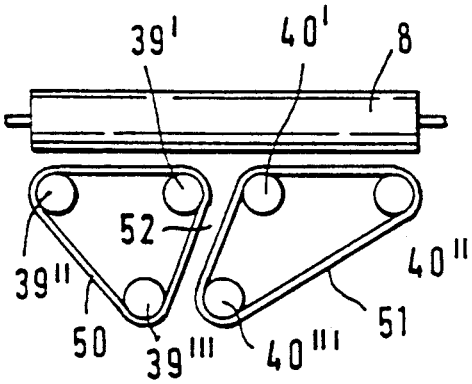
Figure 13B:
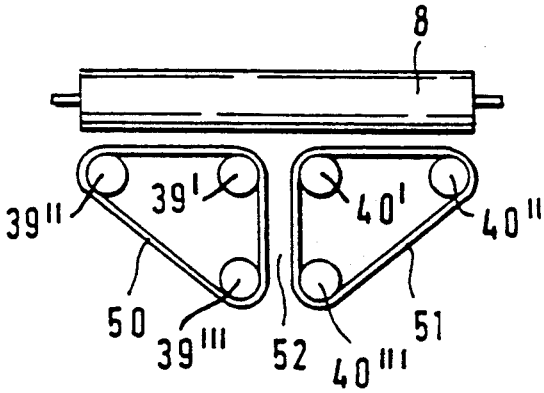

Turning now to FIGS. 13*a* and 13*b*, there are provided two endless conveyor belts 50, 51 supported by rollers 39', 39'', 39''' and, respectively, 40', 40'' and 40'''. The support rollers 39''' and 49''' are shifted horizontally from the thread-in phase in FIG. 13*a* into the normal operational phase in FIG. 13*b* such that they are arranged vertically underneath the support rollers 39' and 40'. In this manner the intermediary space 52 between the delivery belts 50, 51 is changed from an oblique course to a vertical course.

Figure 14A:
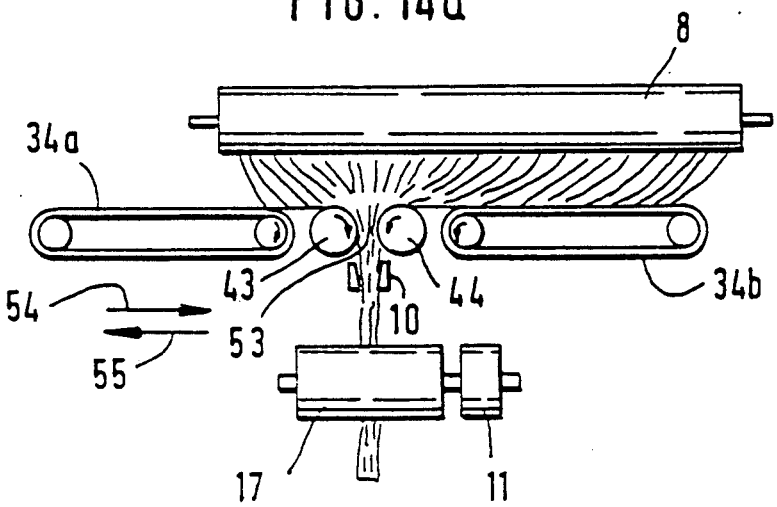
Figure 14B:
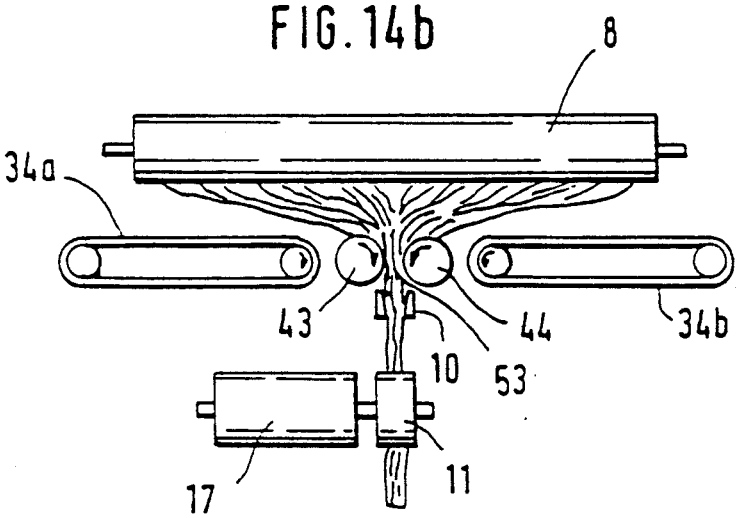

Turning now to FIG. 14*a*, in the startup phase the delivery rolls 43 and 44 and the outlet opening 53 defined thereby as well as the gathering trumpet 10 are arranged vertically above the delivery roll pair 17. In the thread-in phase (production phase) depicted in FIG. 14*b*, the delivery belts 34*a*, 34*b*, the delivery rolls 43, 44 and the gathering trumpet 10 have been shifted together in the direction of the arrow 54 so that the delivery rolls 43, 44, with the outlet opening 53 defined thereby and the gathering trumpet 10 are arranged vertically above the calender roll pair 11. In this manner, the fiber web (pre-sliver) discharged through the outlet opening defined by the delivery rolls 43, 44 is, in the startup phase as well as in the threading or production phase vertically aligned with the gathering trumpet 10. Thus, because of a smaller deflection, the pull on the material as viewed transversely is more uniform and further, sliver ruptures are prevented.

It will be understood that the above description of the present invention is susceptible to various modifications, changes and adaptations, and the same are intended to be comprehended within the meaning and range of equivalents of the appended claims.

What is claimed is:

1. An automatic startup device for a continuous formation of a sliver from a carded fiber web, comprising (a) a roll assembly having an outlet for discharging the fiber web;

(b) a web transporting means for gathering and advancing the web discharged by said roll assembly; said web transporting means being situated under said roll assembly;

(c) a trumpet situated under said web transporting means for receiving the web therefrom; said trumpet having two separable parts between which the web is introduced, said separable parts each having an inner wall portion forming part of a passage for the web; said separable parts having a first position and a second position; in said first position the two trumpet parts are at a relatively large distance from one another, whereby the web is discharged by the trumpet in a substantially unaltered state; in said second position the two trumpet parts are at a relatively small distance from one another, whereby the web is compressed and discharged by the trumpet as a sliver;

(d) a web delivery means for receiving the web, when said separable parts are in said first position, at least indirectly from said web transporting means for carrying the web away; said web delivery means being situated under said web transporting means and said trumpet; and (e) a calender roll pair arranged under said trumpet for receiving and advancing the sliver discharged by said trumpet when said separable parts thereof are in said second position; said trumpet as a whole having relative first and second positions with respect to said web delivery means and said calender roll pair; in one of the relative positions said trumpet being in alignment with said calender roll pair for receiving the sliver discharged by said trumpet.

2. A startup device as defined in claim 1, wherein said web transporting means comprises a web transporting roll pair.

3. A startup device as defined in claim 1, wherein said web transporting means comprises an endless conveyor belt arranged for receiving and conveying the web discharged by said roll assembly.

4. A startup device as defined in claim 1, further comprising means for providing for a displaceability of said web transporting means in a substantially vertical plane towards and away from said roll assembly.

5. A startup device as defined in claim 1, wherein said web transporting means comprises a plate arranged underneath the roll assembly for guiding the web discharged by the roll assembly.

6. A startup device as defined in claim 1, wherein said web delivery means comprises a suction device for carrying away the web.

7. A startup device as defined in claim 1, in combination with a sliver coiler; said sliver coiler having a sliver pressing roll pair constituted by said calender roll pair.

8. A startup device as defined in claim 1, in combination with a sliver coiler; said sliver coiler having a sliver trumpet constituted by the trumpet of the startup device.

9. A startup device as defined in claim 1, wherein said calender roll pair is formed of a calender roll having a circumferential groove and a calender roll having a circumferential rib extending into said groove.

10. A startup device as defined in claim 1, wherein one of the trumpet parts has a throughgoing slot; further comprising a sliver clamping means extending through said slot and cooperating with the inner wall portion of another of said trumpet parts for firmly clamping the sliver against said other trumpet part to cause rupturing of the sliver.

11. A startup device as defined in claim 1, in combination with a sliver coiler; said web transporting means, said web delivery means, said calender roll pair and said trumpet being arranged above said sliver coiler.

12. A startup device as defined in claim 1, wherein said trumpet is shiftable as a whole.

13. A startup device as defined in claim 1, wherein said trumpet has a passage of rectangular cross section defined by two pairs of oppositely arranged wall portions; at least one of said pairs of oppositely arranged wall portions being formed of slide members for varying a width dimension of said passage; said slide members constituting said separable parts.

14. A startup device as defined in claim 1, wherein said web transporting means has a horizontally shiftable web discharge opening.

15. A startup device as defined in claim 1, wherein said web delivery means comprises a web delivery roll pair.

16. A startup device as defined in claim 15, wherein said web delivery means further comprises a suction device arranged for receiving the web discharged by the delivery roll pair.

17. A startup device as defined in claim 15, wherein said trumpet is displaceable in a substantially vertical plane towards and away from said delivery roll pair and said calender roll pair.

18. A startup device as defined in claim 15, wherein said trumpet is displaceable back and forth horizontally above said delivery roll pair and said calender roll pair.

19. A startup device as defined in claim 15, wherein said web delivery roll pair and said calender roll pair form a movable unit having a first position and a second position horizontally spaced from said first position.

20. A startup device as defined in claim 15, wherein said web delivery roll pair and said calender roll pair are arranged in axial alignment relative to one another.

21. A startup device as defined in claim 1, wherein said web transporting means comprises longitudinally aligned first and second endless conveyor belts positioned by supporting rollers and having conveying faces oriented parallel to the longitudinal extent of said roll assembly; one of said supporting rollers associated with the first endless conveyor belt and one of said supporting rollers associated with the second endless conveyor belt being adjoining rollers; further comprising a web advancing roll pair situated between said adjoining rollers and being axially parallel therewith; said advancing roll pair being arranged for receiving and advancing the web obtained from said endless conveyor belts.

22. A startup device as defined in claim 21, wherein the direction of run of said endless conveyor belts is reversible.

23. A startup device as defined in claim 21, wherein said endless conveyor belts have a first position and a second position vertically spaced from said first position.

24. A startup device as defined in claim 21, wherein said support rollers and said first and second endless conveyor belts have a first position and a second position horizontally spaced from said first position.

25. A startup device as defined in claim 21, wherein said web advancing roll pair has a first position and a second position horizontally spaced from said first position.

26. A startup device as defined in claim 21, wherein said web advancing roll pair is formed of two web advancing rollers having a first position and a second position horizontally spaced from said first position; said web advancing rollers being at different distances from one another in said first position and in said second position.

27. A method of automatically starting a continuous formation of a sliver from a carded web, comprising the following steps:

(a) discharging a carded fiber web by a roll assembly;
(b) after step (a), gathering and advancing the web by a web transporting arrangement;
(c) after step (b), introducing the web at a uniform speed to a web delivery arrangement in a startup phase for eliminating the web supplied by the roll assembly during the startup phase;
(d) removing the web from the web delivery arrangement;
(e) after step (b), in said startup phase, surrounding the web by a trumpet having a trumpet passage set to a relatively large width for allowing the web to pass through said trumpet substantially unaltered;
(f) after step (e) in a threading phase following said startup phase, changing the trumpet passage to a relatively narrow width for compressing the web running through the passage for forming a sliver from the web;
(g) after step (f), severing the running sliver at a location upstream of the web delivery arrangement as viewed in a direction of sliver run;
(h) aligning said trumpet with a calender roll pair; and
(i) after step (g), automatically introducing a leading end of the running sliver into the calender roll pair.

28. A method as defined in claim 27, wherein step (d) includes the step of removing the web from the web delivery arrangement by suction.

* * * * *